US008651628B2

(12) United States Patent
Sasaki

(10) Patent No.: US 8,651,628 B2
(45) Date of Patent: Feb. 18, 2014

(54) LIQUID DROPLET EJECTING HEAD AND IMAGE FORMING APPARATUS

(71) Applicant: Takafumi Sasaki, Kanagawa (JP)

(72) Inventor: Takafumi Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/736,221

(22) Filed: Jan. 8, 2013

(65) Prior Publication Data

US 2013/0176363 A1 Jul. 11, 2013

(30) Foreign Application Priority Data

Jan. 10, 2012 (JP) ..... 2012-002010

(51) Int. Cl.
*B41J 2/045* (2006.01)

(52) U.S. Cl.
USPC ..... 347/68

(58) Field of Classification Search
USPC ..... 347/40–43, 47, 67–72
See application file for complete search history.

(56) References Cited

U.S. PATENT DOCUMENTS 8,016,392 B2 * 9/2011 Sekiguchi ..... 347/68
8,042,911 B2 10/2011 Sasaki
8,123,337 B2 * 2/2012 Drury et al. ..... 347/69
8,197,048 B2 6/2012 Yamanaka et al.
2007/0008388 A1 1/2007 Yamaguchi et al.
2007/0103519 A1 5/2007 Takahashi et al.
2009/0009569 A1 1/2009 Sasaki
2009/0102907 A1 4/2009 Yamanaka et al.
2012/0069071 A1 3/2012 Sasaki

FOREIGN PATENT DOCUMENTS

JP 2007-307774 11/2007
JP 2009-090674 4/2009
JP 4770401 7/2011

OTHER PUBLICATIONS

U.S. Appl. No. 13/609,125, filed Sep. 10, 2012, Sasaki.

* cited by examiner

*Primary Examiner* — Lamson Nguyen
(74) *Attorney, Agent, or Firm* — Oblon, Spivak, McClelland, Maier & Neustadt, L.L.P.

(57) ABSTRACT

A liquid droplet ejecting head is disclosed which includes at least one or more nozzles which eject liquid droplets; one or more dedicated liquid chambers which are communicatively connected to the nozzle; a common liquid chamber which is communicatively connected to the dedicated liquid chamber; and an energy generating unit which generates energy provided to the dedicated liquid chamber, wherein at least one wall face of the common liquid chamber includes a flexible wall, which has flexibility; a buffer chamber is included in an opposing area via the flexible wall and the common liquid chamber; and wherein the buffer chamber is communicatively connected to an external space in an area not opposing the common liquid chamber.

7 Claims, 7 Drawing Sheets

LIQUID DROPLET EJECTING HEAD AND IMAGE FORMING APPARATUS

TECHNICAL FIELD

The present invention relates to liquid droplet ejecting heads and image forming apparatuses.

BACKGROUND ART

As an image forming apparatus for a printer, a facsimile machine, a copying apparatus, and a multifunctional machine having these functions, an inkjet recording apparatus is known which includes a liquid droplet ejecting apparatus using a liquid droplet ejecting head as a recording head, for example. The inkjet recording apparatus ejects a recording material (ink) from a liquid droplet ejecting head to a sheet (not limited to paper and includes an OHP sheet, etc., representing what a recording liquid such as ink, etc., and other liquids, etc., can be adhered to; also called a "medium to be recorded on", or a "recording medium", "recording paper", etc.) to perform recording, making it possible to record a very fine color image at high speed. Moreover, the inkjet recording apparatus is also used in an industrial system such as a textile printing apparatus, etc.

Such a liquid droplet ejecting head for use in such an inkjet recording apparatus generally includes multiple nozzle sequences; and multiple dedicated liquid chambers (also called "pressure chambers") which are communicatively connected to the nozzle sequence, to which multiple dedicated liquid chambers of a common recording material storage unit (also called "a common liquid chamber") with a relatively large volume is communicatively connected. Energy may be selectively applied to the dedicated liquid chamber to deform the dedicated liquid chamber and cause liquid droplets to be ejected to form an arbitrary image on demand. As a medium for applying energy, a piezoelectric element, a heater chip, etc., are known.

Recently, there is a demand for an image forming apparatus to be able to output a higher definition image at a higher printing speed. In response to the demand for the higher definition image, there is a trend for an increased number of nozzles and a higher density. In conjunction thereto, there is a trend toward a narrower gap between respective dedicated liquid chambers and also a higher frequency of energy application. In response to the demand for the higher printing speed, there is an attempt to lengthen the recording head, and a so-called "line-type printer" is also proposed which includes the recording head which may cover the whole width region of the recording medium.

Energy applied to the dedicated liquid chamber causes a pressure variation in liquid droplets (recording material) within the dedicated liquid chamber, which pressure variation also spreads to a common liquid chamber to which it is communicatively connected and also influences, as a matter of course, a recording medium within a different neighboring dedicated liquid chamber (this is called "a mutual interference").

There is a problem that the mutual interference induces unintended ejecting of liquid droplets or destabilizing of an ejection state, resulting in not being able to obtain a high definition image output.

A configuration provided with a damper is disclosed for preventing such a mutual interference (see Patent Documents 1 to 3, for example).

Patent Document 1 discloses an inkjet head which can prevent ink from penetrating into a damper chamber. In the inkjet head, a concave portion is provided by half etching at a position which opposes a portion at which a manifold continues from an opening, which position is on a face which is joined to a nozzle plate of a cover plate, which concave portion is sealed by the nozzle plate to form the damper chamber. It is disclosed therein that this damper chamber is for absorbing the pressure variation which is spread from the pressure chamber to the manifold, and grooves, which respectively extend from the damper chamber, formed on the cover plate, are formed and connect to a hole communicatively connected to the atmosphere.

Patent Document 2 discloses an inkjet head which is provided with a substrate which forms a common liquid chamber and a damper immediately below a substrate in which dedicated liquid chambers are formed. Patent Document 3 discloses a liquid ejecting head, wherein a buffer chamber is formed on the same plane as a dedicated liquid chamber forming portion.

PATENT DOCUMENTS

Patent Document 1 JP2009-90674A
Patent Document 2 JP4770401B
Patent Document 3 JP2007-307774A However, with the inkjet head disclosed in Patent Document 1, there are problems that, a damper is formed where the manifold is provided separately from a common ink chamber, leading to an enlargement of a layout; a damper chamber is located remotely from the common ink chamber, leading to a decreased damping effect; and a large area as a damper cannot be secured, leading to a limited effect of damping the pressure variation. A mode is disclosed therein, wherein the damper is formed by half etching of a metal member. In general metals have high rigidity, possibly causing the damping effect to be further restricted.

With the inkjet head disclosed in Patent Document 2, increasing the volume of the common liquid chamber, which causes the number of substrates to increase, also causes the volume of a communicatively connecting tube which leads from the dedicated liquid chamber to the nozzle to increase, which could result in not being able to obtain desired injection characteristics. Moreover, there is a problem that an inability to set the volume of the common liquid chamber larger, which leads to limiting an amount of supply of the recording material, causing an inability to use a recording material with a high viscosity. Moreover, the damper chamber (the concave portion) is not opened to the atmosphere, so that there is a possibility of not being able to sufficiently obtain an effect of damping a common liquid chamber pressure.

With the liquid ejecting head disclosed in Patent Document 3, it is difficult to secure a large buffer chamber, possibly causing a damping function to not be secured adequately. In general, for the dedicated liquid chamber forming member, due to a need for increasing a forming accuracy of the dedicated liquid chamber, an expensive member such as Si, etc., is used, so that it is difficult to secure a large buffer chamber due to a cost problem. Moreover, PZT is located near a position at which the buffer chamber is communicatively connected to the atmosphere. The buffer chamber faces the common liquid chamber via one thin film, so that, when the film is a resin thin film, for example, air with high humidity flows into the vicinity of the PZT due to moisture permeation thereof, possibly inducing an unexpected failure such as migration.

DISCLOSURE OF THE INVENTION

Thus, in view of the problems as described above, an object of the present invention is to provide a liquid droplet ejecting head which includes a superior damping function of preventing mutual interference caused through a common liquid chamber and which can be realized in a small size and at a low cost.

According to an embodiment of the present invention, a liquid droplet ejecting head is provided, including: at least one or more nozzles which eject liquid droplets; one or more dedicated liquid chambers which are communicatively connected to the nozzle; a common liquid chamber which is communicatively connected to the dedicated liquid chamber; and an energy generating unit which generates energy provided to the dedicated liquid chamber, wherein at least one wall face of the common liquid chamber includes a flexible wall, which has flexibility; a buffer chamber is included in an opposing area via the flexible wall and the common liquid chamber; and wherein the buffer chamber is communicatively connected to an external space in an area not opposing the common liquid chamber.

The liquid droplet ejecting head according to the present invention makes it possible to provide a liquid droplet ejecting head which includes a superior damping function of preventing mutual interference caused through a common liquid chamber and which can be realized in a small size and at a low cost.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Below a liquid droplet ejecting head and an image forming apparatus according to the present invention are described with reference to the drawings. The present invention is not to be limited to those exemplified in embodiments shown below, so that it may be changed within a range which a skilled person would have arrived at, including other embodiments, additions, modifications, deletions, etc., so that any mode thereof is to be included in the scope of the present invention as long as it effects functions and advantages of the present invention.

First Embodiment

Figure 1A:
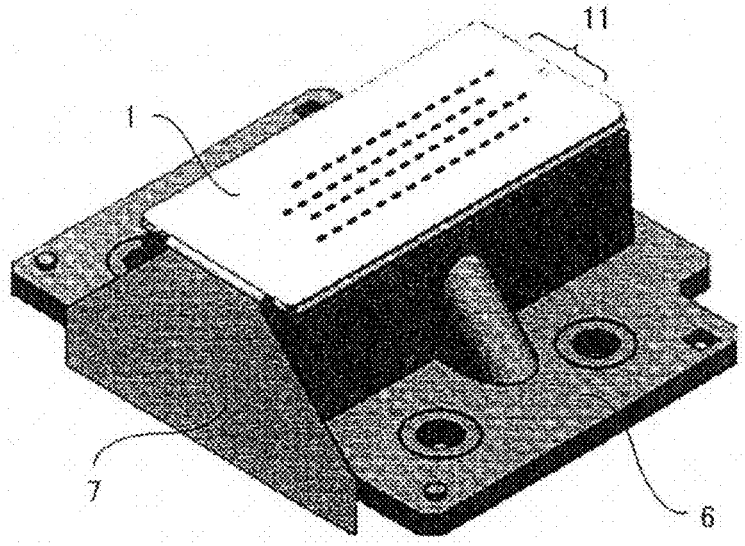
FIGS. 1A and 1B are perspective views showing an embodiment of a liquid droplet ejecting head according to the present invention.
Figure 1B:
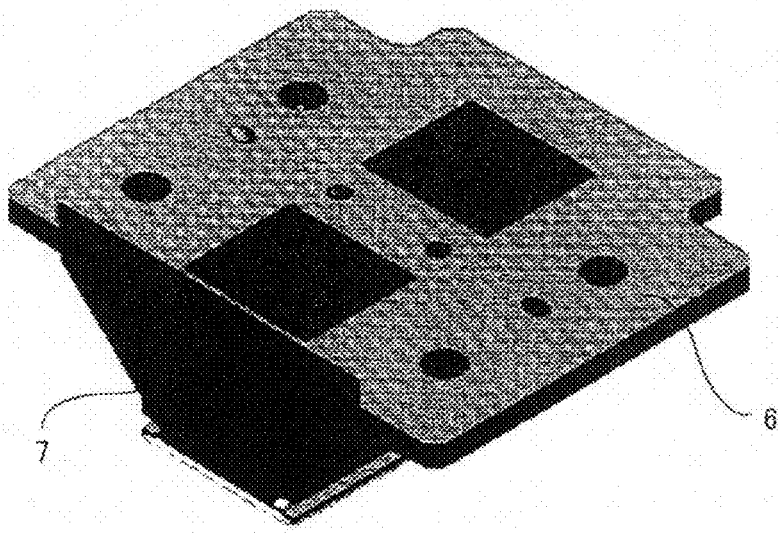

FIG. 1A is a perspective view showing an external view of one embodiment of a liquid droplet ejecting head according to the present invention, while FIG. 1B is a perspective view showing the external view of the opposite face of one embodiment of the liquid droplet ejecting head according to the present invention.

Figure 2:
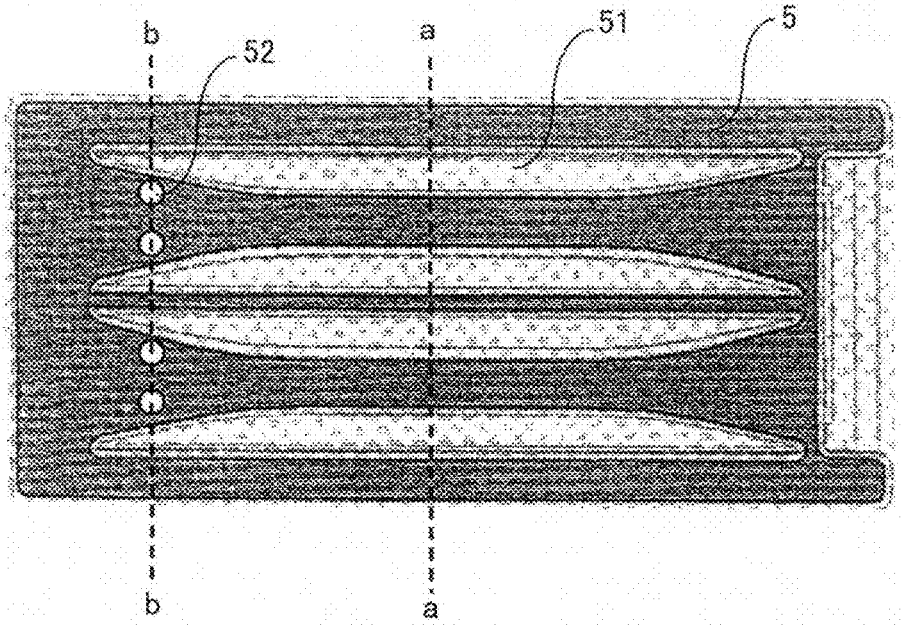
FIG. 2 is a plane view showing a major part of one embodiment of the liquid droplet ejecting head according to the present invention.
Figure 3A:
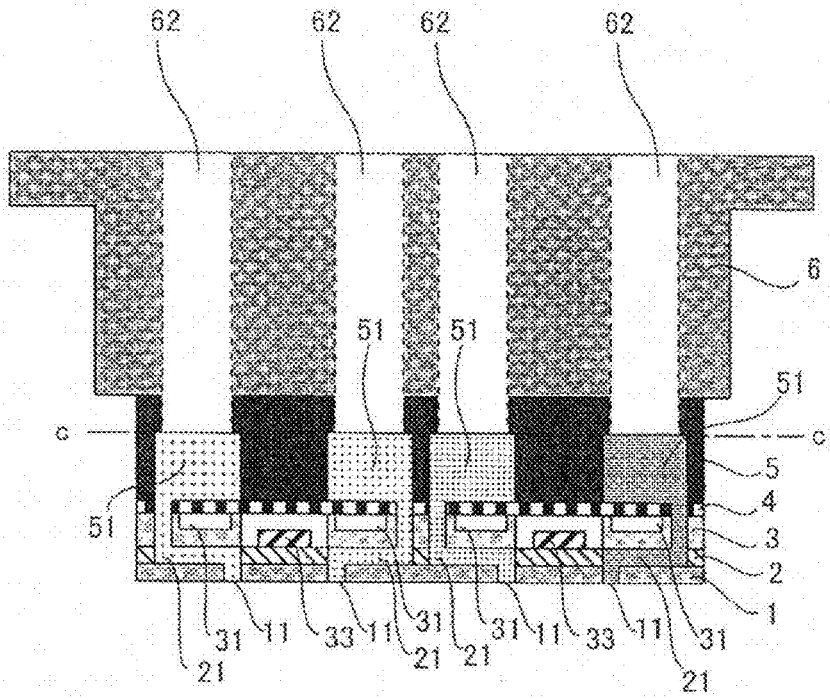
FIGS. 3A and 3B are sectional views showing a major part of one embodiment of the liquid droplet ejecting head according to the present invention.
Figure 3B:
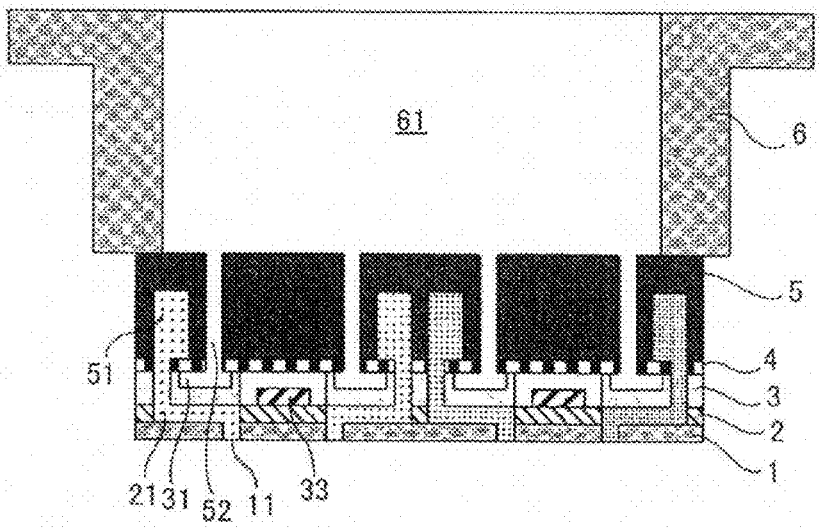

FIG. 2 is a plane view of a major portion of one embodiment of the liquid droplet ejecting head according to the present invention, while FIG. 3A is a sectional view thereof along a-a and FIG. 3B is a sectional view thereof along b-b. FIG. 2 is a sectional view of FIG. 3A along c-c.

As shown in FIGS. 3A and 3B, the liquid droplet ejecting head according to the present invention includes at least multiple nozzles 11 which eject liquid droplets; multiple dedicated liquid chambers (below called "pressure chambers") which are communicatively connected to the nozzles; a common liquid chamber 51 which is communicatively connected to the dedicated liquid chambers; and an energy generating unit which generates energy to be provided to the dedicated liquid chambers 21, wherein at least one wall face of the common liquid chamber 51 is made up of a flexible wall 4 (below called "a damper film"), which has flexibility, includes a buffer chamber 31 in a region which opposes the common liquid chamber 51 via the flexible wall 4, and the buffer chamber 31 is communicatively connected to an external space 61 in a region which does not oppose the common liquid chamber 51.

Moreover, there is a housing 6 which houses each component to mount to the image forming apparatus and in the housing is formed, at a generally central portion in a longitudinal direction, an ink supplying tube 62 for communicatively connecting, to the common liquid chamber 51, an ink supplied from an ink tank (not shown).

In an actuator plate 2 is formed nozzles 11 and a thin film piezoelectric element in correspondence with a pressure chamber 21 which is communicatively connected to the respective nozzle 11. An electrical signal which is supplied from an image forming apparatus body is applied via an FPC 7 shown in FIGS. 1A and 1B to an electrode which is formed on a piezoelectric material. A signal may be switched by an IC 33 to deform an arbitrary piezoelectric element. In conjunction with deforming of the piezoelectric element, a vibrating plate which is integrally formed with the piezoelectric element is displaced and a volume of the pressure chamber 21 is changed. Then, pressure is applied to a liquid inside the pressure chamber 21 and liquid droplets are ejected from a nozzle opening.

In the present embodiment, the piezoelectric elements are arranged at intervals of 600 dpi and are aligned in four columns in an opposing manner.

In the present embodiment, in a nozzle plate 1, which is made of an SUS material with a plate thickness of 50 μm, a hole with a diameter of 20 μm is formed by press working. A total of 1280 nozzles are formed in four columns of each color of 320.

In a backing plate 3, which is made of a silicon plate with a thickness of 400 μm, a communicatively connecting path is formed which communicatively connects the dedicated pressure chamber 21 and the common liquid chamber 51 and an air gap which holds therein an IC 33, forming an opening by anisotropically etching the silicon plate. Moreover, a buffer chamber 31 is formed which is a concave portion, wherein a face opposing the common liquid chamber 51 is covered with a damper film 4.

The damper film 4 is preferably a resin film and is preferably a film which has liquid contactability with liquid droplets (a recording material such as ink, etc.) to be ejected. Such a film includes a PPS film (Product name: Torelina, manufactured by Toray Industries, Inc., for example), a PI film (Product name: UPILEX, manufactured by Ube Industries, Ltd., for example), etc., for example.

A thickness of the damper film 4 is preferably between approximately 10 μm and 20 μm.

The backing plate 3 and the damper film 4 are joined by an adhesive material.

The damper film 4 preferably includes a moisture permeation preventing film.

The moisture permeation preventing film may be formed by depositing $SiO_2$, etc., or forming a metal (Ti, Nb, etc.) onto the damper film 4 by sputtering, for example. The moisture permeation preventing film can be formed to prevent an increase in an ink viscosity due to moisture permeation.

The damper film 4 may be a film other than a resin film, so that an $SiO_2$ film, which is formed by a semiconductor process, for example, may be applied.

As shown in FIG. 2, a common liquid chamber 51 has a shape such that both ends thereof in a longitudinal direction (an alignment direction of the nozzle) are narrowed. FIG. 2 is a sectional view along c-c of FIG. 3A, so that the housing 6 is not shown.

The shape in which ends of the common liquid chamber 51 is narrowed is important for improving the replenishability of ink. Such a shape leads to obtaining an advantage such that an ink flow speed increases in the vicinity of the end of the common liquid chamber 51 and it becomes easier for air bubbles to flow within the common liquid chamber 51.

As shown in FIG. 3B, the buffer chamber 31 is communicatively connected to the external space 61 via a communicatively connecting channel 52. The communicatively connecting channel 52 is formed by a common liquid chamber forming member 5, making it possible to effectively attenuate a pressure variation within the common liquid chamber 51 by communicatively connecting with the external space without enlarging the liquid droplet ejecting head in a simple configuration.

For a wall face of the common liquid chamber 51, a wall face opposing the dedicated liquid chamber 21 is made up of the damper film 4, and the buffer chamber 31 is formed via the damper film 4, leading to having a compliance, which is a serial combination of a mechanical compliance due to rigidity of the damper film 4 and a compressive compliance which is determined by a volume elasticity of air in the buffer chamber 31.

It is effective to increase the combined compliance for attenuating the pressure variation of the common liquid chamber 51.

The concave portion which forms the buffer chamber 31 is formed on a silicon wafer, so that it is difficult to increase the volume thereof from a cost viewpoint. In the present embodiment, a width of the concave portion is set to 1 mm, a length thereof is set to 27.9 mm, and a depth thereof is set to 0.3 mm.

The volume elasticity of air is $1.4\times10^5$ Pa, while the compressive compliance when the buffer chamber 31 is a sealed space is determined by a volume×the volume elasticity, which is approximately $6\times10^{-14}$ $m^3$/Pa. On the other hand, the mechanical compliance of the same area of the PPS film with a Young's modulus of approximately 3 GPa and a thickness of 10 μm is $1.4\times10^{-13}$ $m^3$/Pa, so that the compressive compliance of air becomes predominant.

The combined compliance is $(6\times10^{-14}\times1.4\times10^{-13})/(6\times10^{-14}+1.4\times10^{-13})=4.2\times10^{-14}$ $m^3$/Pa.

On the other hand, when the buffer chamber 31 is communicatively connected to the outside, the compressive compliance of air may be ignored with the mechanical compliance of the damper film becoming predominant, thus making it possible to effectively attenuate the pressure variation within the common liquid chamber 51. In this way, while the feature of communicatively connecting the buffer chamber 31 to the outside is known, the buffer chamber 31 is formed in proximity to and at a position which directly faces the common liquid chamber 51 which is adjacent to the dedicated liquid chamber (pressure chamber) 21, making it possible to further increase the effect of attenuating the pressure variation.

Moreover, there is a high degree of freedom of selecting a material of the damper film 4 and it is easy to select a material with a low rigidity, making it possible to further increase the attenuation effect of the pressure variation.

Furthermore, the communicatively connecting channel 52, which is communicatively connected to the outside, is formed at a portion at which the common liquid chamber 51 is narrowed in the first place (a region at which a common liquid chamber is formed in the first place), making it possible to realize a communicative connection with the outside without changing an external form (size) of the liquid droplet ejecting head and to make the size of the apparatus smaller.

Second Embodiment

Figure 4:
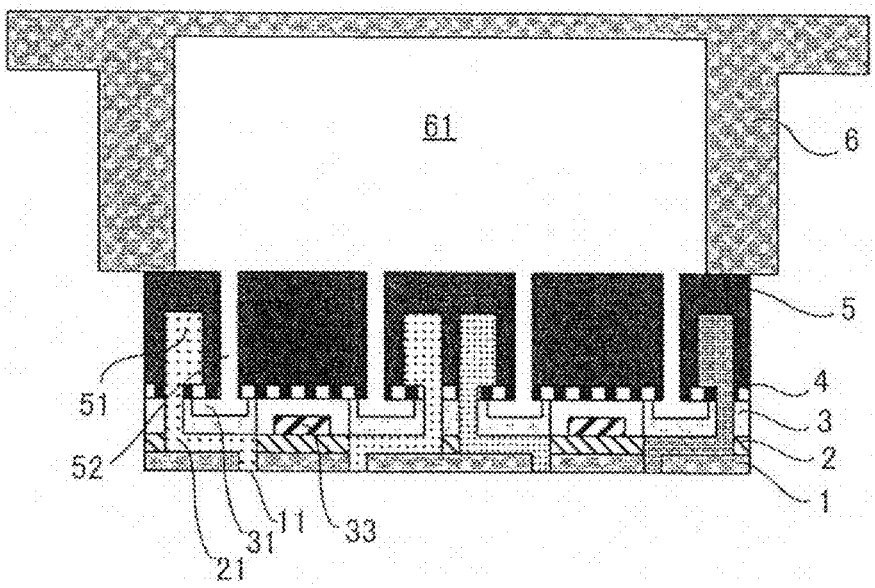
FIG. 4 is a sectional view showing a major part of another embodiment of the liquid droplet ejecting head according to the present invention.

FIG. 4, which is a drawing illustrating a Second Embodiment of the liquid droplet ejecting head according to the present invention, is a sectional view along b-b of the area shown in FIG. 2.

As shown in FIG. 4, while the buffer chamber 31 is communicatively connected to the external space 61 through the communicatively connecting channel 52, the external space 61 which is communicatively connected thereto is a sealed space with a relatively large volume, not being open to the atmosphere.

When a resin film is used for the damper film 4, moisture in ink within the common liquid chamber 51 may evaporate through a moisture-permeating resin film, increasing an ink viscosity. When the ink viscosity increases, the ejecting characteristics change, possibly causing deterioration of an image quality. While it is preferable to seal the buffer chamber 31 in order to suppress an increase in the ink viscosity, the sealing of the buffer chamber exacerbates mutual interference caused through the common liquid chamber. Thus, according to the present embodiment, the external space 61 which is connected thereto has a relatively large volume within the housing 6 is arranged to be a sealed space which is not communicatively connected to the atmosphere.

According to the present embodiment, the external space 61 has a volume of (10 mm×10 mm×10 mm)×2, and the compressive compliance thereof is $1.43\times10^{-11}$ $m^3$/Pa. The value is a rigidity which is sufficiently larger than the mechanical compliance of the damper film 4 and is negligible. Moreover, the external space 61 is a sealed space, making it possible to prevent moisture evaporation of ink through the damper film 4.

Figure 5:
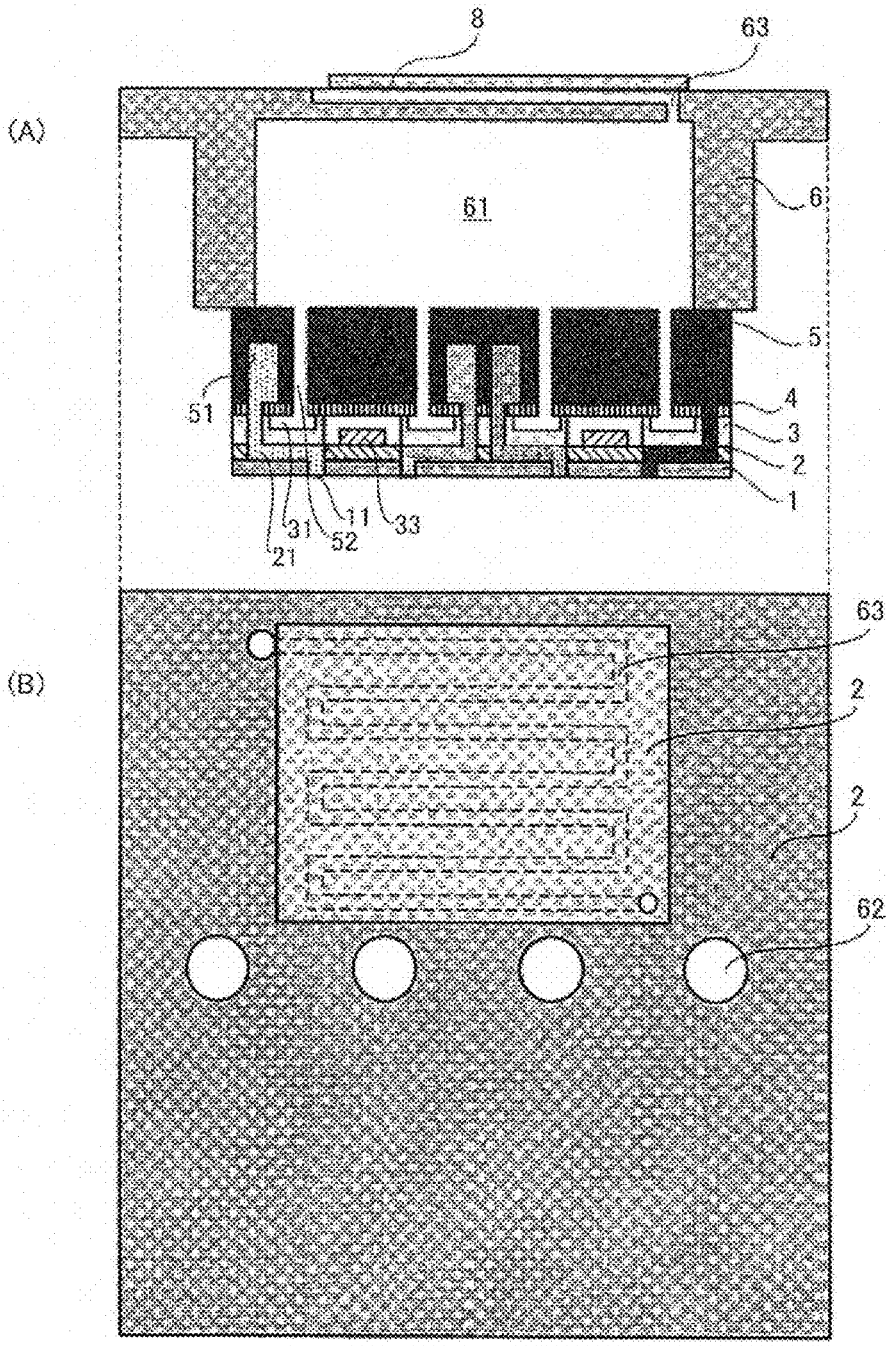
FIG. 5 is a sectional view of a major part of and a plane view of a further embodiment of the liquid droplet ejecting head according to the present invention.

Third Embodiment (A) in FIG. 5, illustrating a Third Embodiment of the liquid droplet ejecting head according to the present invention, is a sectional view along b-b of an area shown in FIG. 2. (B) in FIG. 5 is a plane view of an upper portion thereof.

According to the present embodiment, the buffer chamber is communicatively connected to the external space 61 through the communicatively connecting channel 52, while the external space 61 to which it is communicatively connected is communicatively connected to the atmosphere through a snake line 63.

The snake line 63 is formed as a groove cut on a top face of the housing 6, which groove having a length of 100 mm, and a cross section of a height of 300 μm and a width of 300 μm. It is formed by sealing this groove with a moisture permeation preventing film 8 (an aluminum sheet, for example).

Such a configuration makes it possible to prevent ink within the common liquid chamber 51 from evaporating and to ignore altogether the compressive compliance of air in the buffer chamber relative to the configuration of FIG. 3B in which the whole external space 61 which is communicatively connected to the buffer chamber 31 is arranged to be open. Thus, a high damping function which prevents mutual interference caused through the common liquid chamber is obtained.

Fourth Embodiment

Image Forming Apparatus

Figure 6:
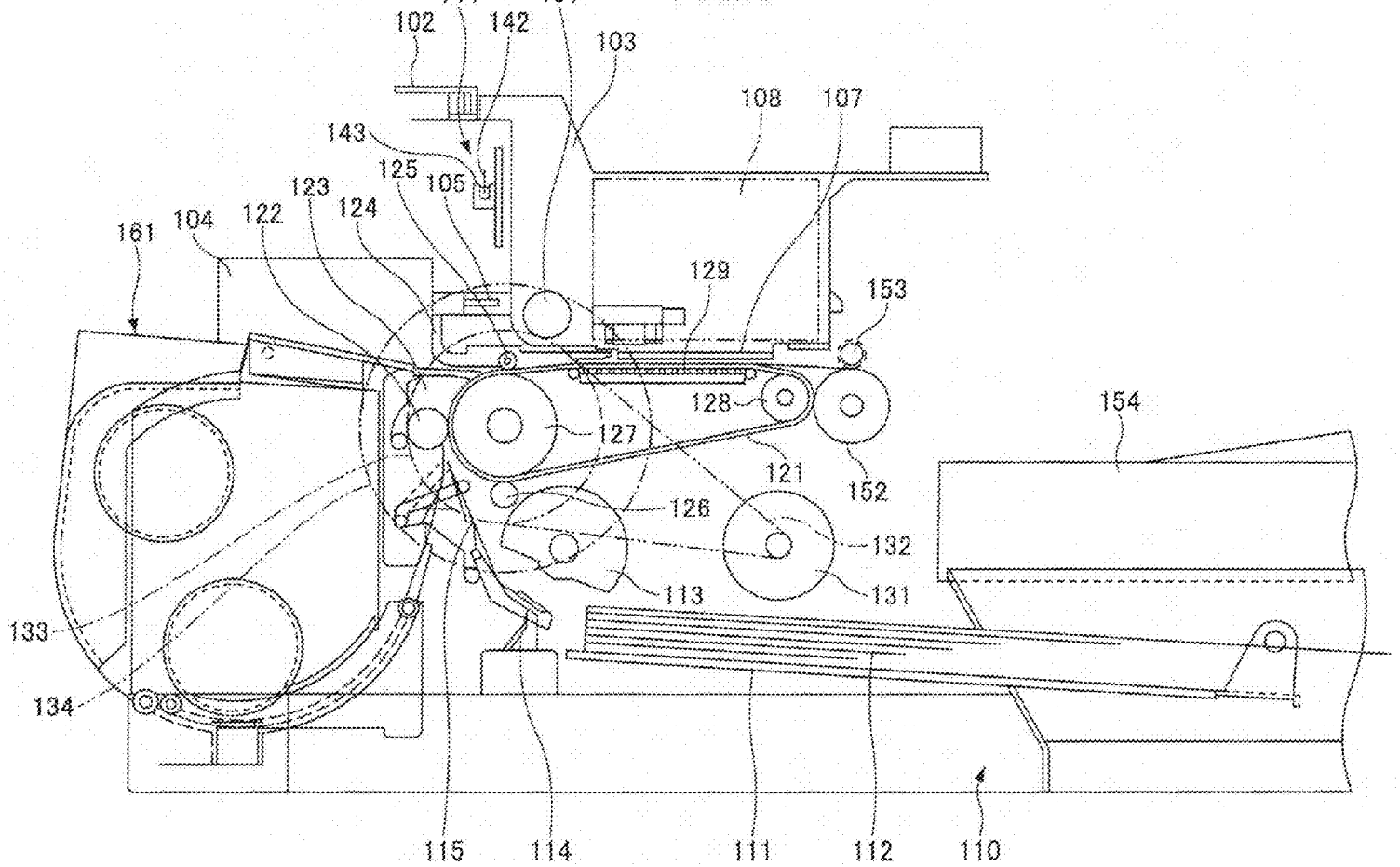
FIG. 6 is a side view for explaining an overall configuration of a machinery unit showing one embodiment of an image forming apparatus of the present invention.
Figure 7:
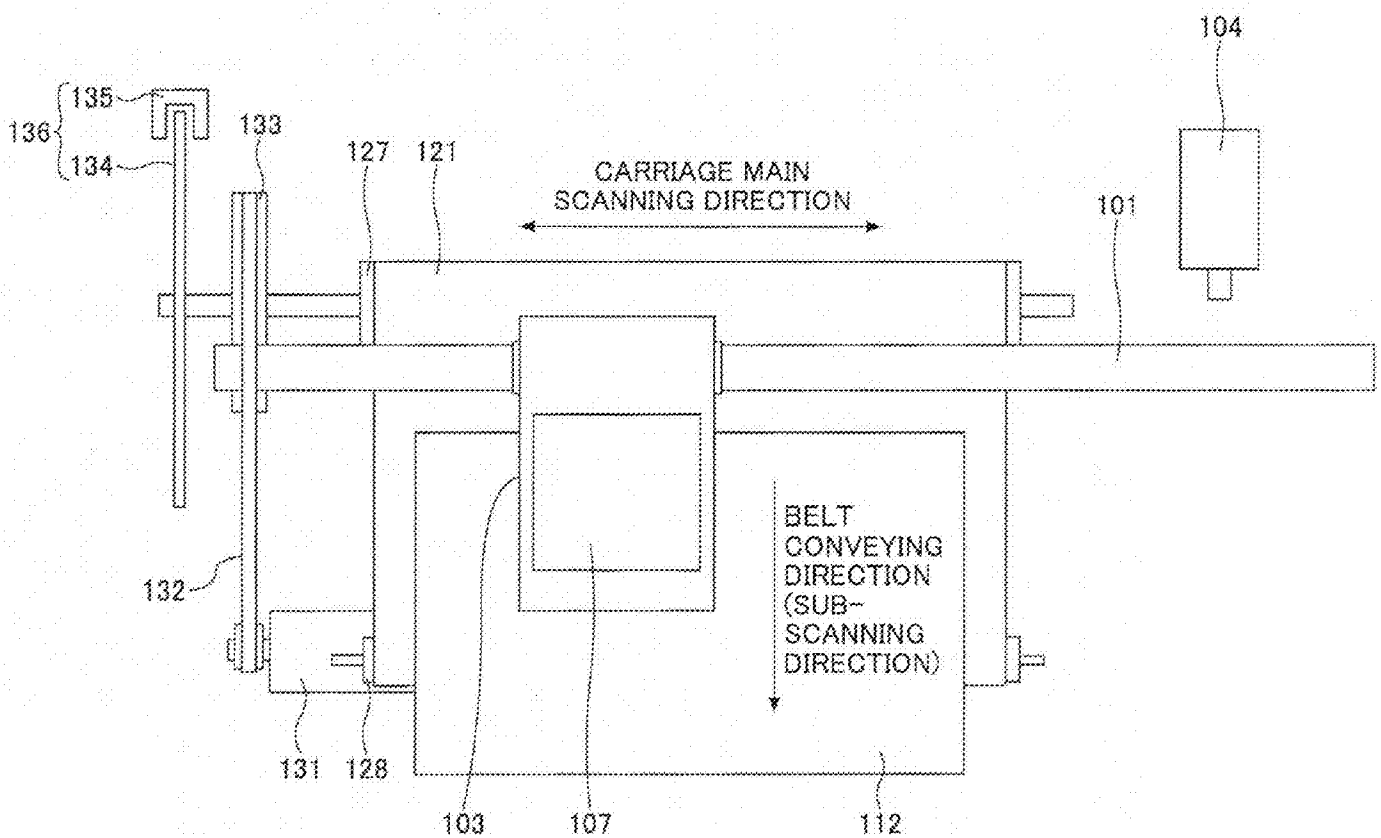
FIG. 7 is a plane view of a major portion showing one embodiment of the image forming apparatus of the present invention.

An example of an image forming apparatus according to the present embodiment of the present invention is shown in FIGS. 6 and 7.

FIG. 6 is a side face view for explaining an overall configuration of a machinery unit according to one embodiment of the image forming apparatus, while FIG. 7 is a plane view of a major portion thereof.

The image forming apparatus according to the present invention includes the liquid droplet ejecting head of the present invention as the recording head.

The image forming apparatus holds a carriage 103 such that it is able to slide in a main scanning direction with a guiding rod 101 and a guiding rail 102 which are guide members built across left and right side plates (not shown), and such that, with a main scanning motor 104, it moves and scans in a direction shown with an arrow (a main scanning direction) in FIG. 7, via a timing belt 105.

On the carriage 103, an inkjet recording head 107, a liquid droplet ejecting head of the present invention, that ejects ink droplets of respective colors of yellow, cyan, magenta, and black, for example, is mounted such that multiple ink ejecting ports are aligned in a direction which crosses the main scanning direction and an ink droplet ejecting direction faces downward.

Moreover, the carriage 103 has mounted thereon a sub tank 108 for each color for supplying ink of each color to the inkjet recording head 107. Ink is supplied to the sub tank 108 from a main tank (an ink cartridge) via an ink supply tube (not shown).

While an image forming apparatus, which is a liquid droplet ejecting apparatus according to the present invention, is configured by the sub tank 108 and the inkjet recording head 107 of the present invention, the sub tank 108 may be provided separately, or an ink cartridge may be mounted therein without using the sub tank.

On the other hand, as a paper-supply unit for supplying sheets 112 loaded on a sheet loading unit 111 such as a paper-supply cassette 110, etc., a crescent roller (a paper-supply roller) 113 which feeds, on a sheet by sheet basis, the sheets 112 from the sheet loading unit 111 and a separation pad 114 which opposes the paper-supply roller 113 and which is made of a material with a large friction coefficient, which the separation pad 114 is energized to the paper-supply roller 113 side.

Then, as conveying units for conveying, at the lower side of the recording head 107, the sheets 112 supplied from the paper-supply unit are provided a conveying belt 121 for electrostatically adsorbing the sheets 112 to convey the electrostatically adsorbed sheets 112, a counter roller 122 for conveying the sheets 112 placed between the conveying belt 121 and it that are sent via a guide 115 from the paper-supplying unit, a conveying guide 123 for changing a direction of the sheets 112 sent upward in a generally 90° vertical direction to cause the sheets 112 to follow on the conveying belt 121; and a tip pressure roller 125 which is energized by a pressing member 124 to the conveying belt 121 side. Moreover, a charging roller 126 is provided which is a charging unit for charging a surface of the conveying belt 121.

Here, the conveying belt 121, which is an endless-shaped belt and which is bridged between a conveying roller 127 and a tension roller 128, is arranged to circularly rotate in a belt conveying direction (sub-scanning direction) in FIG. 7 through the conveying roller 127 being rotated by a sub-scanning motor 131 via a timing belt 132 and a timing roller 133. A guide member 129 is arranged on the back face side of the conveying belt 121 in correspondence with a region for image forming by the head 107.

Moreover, as shown in FIG. 7, on an axle of the conveying roller 127 is mounted a circular slit plate 134, and is provided a sensor 135 which senses a slit of the circular silt plate 134, which circular slit plate 134 and the sensor 135 make up an encoder 136.

The charging roller 126, which is in contact with a surface layer of the conveying belt 121, is arranged such that it rotates following a rotational movement of the conveying belt 121, and exerts 2.5 N respectively onto both ends of the axle as applied pressure.

Moreover, on the front side of the carriage 103, as shown in FIG. 6 is provided an encoder scale 142 having formed thereon a slit and on the front face side of the carriage 103 is provided an encoder sensor 143 which includes a transmissive photo sensor which detects a slit of the encoder scale 143, so that the encoder scale 142 and the encoder sensor 143 make up an encoder 144 for detecting a position (a position relative to a home position) in the main scanning direction of the carriage 103.

Moreover, as a paper-output unit for outputting sheets 112 recorded with the inkjet recording head 107, a separating unit for separating the sheets 112 from the conveying belt 121, a paper-output roller 152, a paper-output roller 153, and a paper-output tray 154 which stocks the sheets 112 to be output are provided.

Moreover, a double-sided paper-supplying unit 161 is detachably mounted on a back portion. This double-sided paper-supplying unit 161 takes in sheets 112 returned in a reverse direction rotation of the conveying belt 121 to reverse the sheets so as to supply the sheets again between the counter roller 22 and the conveying belt 121.

In the image forming apparatus arranged as described above, sheets 112 are supplied from a paper-supply unit on a sheet by sheet basis, the sheets 112 supplied generally vertically upward are guided by the guide 115, placed between the conveying belt 121 and the counter roller 122 to be conveyed, has a tip thereof guided with the conveying guide 123 to be pressed against the conveying belt 121 with the tip pressure roller 121, and has the conveying direction turned substantially 90°.

Then, an alternate repetition of a positive output and a negative output, or in other words, an alternating voltage is applied to the charging roller 126 from a high voltage power supply to the charging roller 126 by a control circuit (not shown), so that the conveying roller 121 is charged in alternating voltage charge patterns, or, in other words, alternately charged in a shape of positive and negative bands in a predetermined width in a sub-scanning direction, which is a circularly rotating direction. The sheets 112, when fed onto the conveying belt 121 alternately charged positive and negative, are adsorbed to the conveying belt 121 by an electrostatic force, and conveyed in the sub-scanning direction by a circular rotational movement of the conveying belt 121.

Then, the inkjet recording head 107 is driven according to an image signal while moving the carriage 103 to discharge ink droplets onto sheets 112 at rest to record what amounts to one line, and recording for the following line is performed after the sheets 112 are conveyed for a predetermined amount. When a recording termination signal or a signal that a trailing edge of the sheet 112 has reached a recording area is received, the recording operation is terminated, so that the sheets 112 are output to the paper-output tray 154.

Moreover, for the double-sided printing, the conveying belt 121 is rotated in reverse after recording on a surface (a face to be printed first) is completed to send the recorded sheet 112 into the double-sided paper-supply unit 161 and reverse the sheet 112 (with a back face to be a printing face) to supply the reversed sheet 112 again between the counter roller 122 and the conveying belt 121, a timing control is performed to convey the supplied sheet 112 on the conveying belt 121 to record on a back face thereof, after which the sheet 112 is output to the paper-output tray 54.

The image forming apparatus of the present invention has a liquid droplet ejecting head having a superior damping function of suppressing mutual interference caused through a common liquid chamber, making it possible to dramatically improve a reliability of ink droplet ejecting and to output a higher definition image at a quicker printing speed. Moreover, a liquid droplet ejecting head is provided which makes it possible to realize a small size and a low cost, also making it possible to realize a small size and a low cost of the image forming apparatus.

The image forming apparatus according to the present invention may be applied to a printer, a facsimile apparatus, a copying apparatus, machines having multiple functions thereof. Moreover, it may also be applied to a liquid droplet ejecting head and a liquid droplet ejecting apparatus which ejects a non-ink liquid such as a DNA sample, a resist, a pattern material, etc., for example, or an image forming apparatus which is provided therewith.

The present application is based on Japanese Priority Application No. 2012-002010 filed on Jan. 10, 2012, the entire contents of which are hereby incorporated by reference.

The invention claimed is:

1. A liquid droplet ejecting head, comprising:

at least one or more nozzles which eject liquid droplets;

one or more dedicated liquid chambers which are communicatively connected to the nozzle;

a common liquid chamber which is communicatively connected to the one or more dedicated liquid chambers; and an energy generating unit which generates energy provided to the one or more dedicated liquid chambers; wherein at least one wall face of the common liquid chamber includes a flexible wall, which has flexibility;

a buffer chamber is included in an opposing area via the flexible wall and the common liquid chamber; and wherein the buffer chamber is communicatively connected to an external space in an area not opposing the common liquid chamber.

2. The liquid droplet ejecting head as claimed in claim 1, wherein the common liquid chamber has a shape such that both ends thereof in a longitudinal direction are narrowed; and a location at which the buffer chamber is communicatively connected to the external space is the area not opposing the common liquid chamber due to the narrowing of the common liquid chamber.

3. The liquid ejecting head as claimed in claim 1, wherein a communicatively connecting channel which is communicatively connected to the external space is provided at a member which forms the common liquid chamber.

4. The liquid droplet ejecting head as claimed in claim 1, wherein the flexible wall is made of a resin film.

5. The liquid droplet ejecting head as claimed in claim 4, wherein the flexible wall includes a moisture permeation preventing film.

6. The liquid droplet ejecting head as claimed in claim 1, wherein the external space with which the buffer chamber is communicatively connected is a sealed space.

7. An image forming apparatus, comprising the liquid droplet ejection head as claimed in claim 1.

* * * * *